United States Patent [19]

Jackson et al.

[11] Patent Number: 4,852,632

[45] Date of Patent: Aug. 1, 1989

[54] APPARATUS FOR PREVENTING UNDISSOLVED ALLOYING INGREDIENT FROM ENTERING CONTINUOUS CASTING MOLD

[75] Inventors: Charles R. Jackson, Dyer, Ind.; Daniel Rellis, Jr., Lansing, Ill.; Howard M. Pielet, Munster, Ind.; Debanshu Bhattacharya, Richton Park, Ill.; Larry A. Frank, Crown Point, Ind.; Purnendu Dasgupta, Highland, Ind.; John R. Knoepke, Munster, Ind.

[73] Assignee: Inland Steel Co., Chicago, Ill.

[21] Appl. No.: 259,503

[22] Filed: Oct. 17, 1988

Related U.S. Application Data

[60] Continuation of Ser. No. 134,051, Dec. 17, 1987, abandoned, which is a division of Ser. No. 88,526, Aug. 21, 1987, Pat. No. 4,754,800, which is a continuation of Ser. No. 808,570, Dec. 13, 1985, abandoned.

[51] Int. Cl.[4] ..... B22D 11/10

[52] U.S. Cl. ..... 164/437; 164/134; 222/591

[58] Field of Search ..... 164/134, 337, 437; 222/591; 75/54

[56] References Cited

U.S. PATENT DOCUMENTS

| | | | |
|---|---|---|---|
| 3,549,061 | 12/1970 | Piene | 222/591 |
| 3,934,755 | 1/1976 | Rheinlander et al. | 164/134 |
| 4,125,146 | 11/1978 | Muller et al. | 164/437 |
| 4,368,834 | 1/1983 | Daussan et al. | 164/134 |
| 4,630,668 | 12/1986 | Waltenspuhl | 164/437 |

FOREIGN PATENT DOCUMENTS

| | | | |
|---|---|---|---|
| 2166230 | 5/1973 | Fed. Rep. of Germany | 164/437 |
| 95190 | 7/1970 | France | 164/437 |
| 58-154446 | 9/1983 | Japan | 164/437 |

*Primary Examiner*—Richard K. Seidel

*Attorney, Agent, or Firm*—Marshall, O'Toole, Gerstein, Murray & Bicknell

[57] ABSTRACT

Molten steel containing an undissolved alloying ingredient denser than molten steel (e.g. Pb and/or Bi) flows from a tundish to a continuous casting mold. Various expedients are employed to prevent large globules of undissolved alloying ingredient from flowing out of the tundish into the mold. Another expedient prevents large quantities of undissolved alloying ingredient from accumulating on the bottom of the tundish.

19 Claims, 2 Drawing Sheets

APPARATUS FOR PREVENTING UNDISSOLVED ALLOYING INGREDIENT FROM ENTERING CONTINUOUS CASTING MOLD

This application is a continuation of abandoned application Ser. No. 134,051, filed Dec. 17, 1987, which is a division of application Ser. No. 88,526, filed Aug. 21, 1987, now U.S. Pat. No. 4,754,800, which is a continuation of abandoned application Ser. No. 808,570 filed Dec. 13, 1985.

BACKGROUND OF THE INVENTION

The present invention relates generally to the continuous casting of molten steel and more particularly to preventing undissolved alloying ingredient denser than steel from entering the continuous casting mold.

In the continuous casting of molten steel, a stream of molten steel is poured from a ladle into an intermediate vessel known as a tundish having a bottom containing outlet openings through which molten steel flows into a continuous casting mold. Free machining steels contain lead and/or bismuth to improve the machinability of the steel. Typical contents for each are about 0.04–0.40 wt. % bismuth and 0.05–0.50 wt. % lead.

Lead or bismuth may be added to the stream of molten steel entering the tundish. Lead and bismuth have a relatively low solubility in molten steel, compared to other alloying ingredients added to molten steel, and lead and bismuth are denser than molten steel. Because of these properties, substantial amounts of undissolved lead and bismuth tend to accumulate at the bottom of the tundish. If these accumulations of undissolved lead and bismuth are allowed to flow out through the outlet openings in the bottom of the tundish, they will do so as relatively large globules, and this will be manifest in the solidified steel as large, localized concentrations of lead or bismuth, which is undesirable.

Lead and bismuth each have a lower melting point than steel. Molten lead or bismuth is less viscous than molten steel at the temperature prevailing in the tundish, and molten lead or bismuth has a lower surface tension than does molten steel.

SUMMARY OF THE INVENTION

The present invention provides a method and structure for preventing undissolved molten lead or bismuth from flowing through the outlet openings in the tundish into the continuous casting mold. The present invention also provides a method and structure for withdrawing accumulations of undissolved lead or bismuth from tee tundish without simultaneously removing the molten steel.

Molten steel is conventionally introduced into the tundish at an entry location spaced linearly along the vessel bottom from each of the outlet openings, and the molten steel normally flows along the bottom of the tundish downstream from the entry location to an outlet opening. A method and structure in accordance with the present invention prevents molten metal from flowing along a continuous descending or horizontal path along the tundish bottom from the entry location to an outlet opening. This is accomplished by employing one or more of the following expedients.

The top of the outlet opening is raised above at least that part of the tundish or vessel bottom adjacent the outlet opening. Alternatively, the outlet opening is surrounded with an annular refractory dam located between the entry location and the outlet opening and extending upwardly from the vessel bottom. Another alternative is to slope at least part of the vessel bottom portion which is upstream of the outlet opening, upwardly to the outlet opening. A further alternative comprises interposing at least one non-annular refractory dam between the entry location and the outlet opening. This dam extends upwardly from the vessel bottom and is devoid of flow passageways to a height greater than the thickness of the layer of undissolved alloying ingredient which accumulates on the vessel bottom. Undissolved alloying ingredient can be prevented from accumulating at the upstream side of the dam by sloping the vessel bottom portion at the upstream side of the dam, upwardly to the dam. In the case of the annular refractory dam surrounding the outlet opening, undissolved alloying ingredient can be prevented from accumulating around the outer side of the annular dam by sloping the vessel bottom portion around the outer side of the dam upwardly to the dam.

The dams described in the preceding paragraph usually rest atop the surface of the tundish bottom, and sloping the vessel bottom upwardly to the dam, in the manner described above, prevents undissolved alloying ingredient from seeping or otherwise flowing underneath the dam to the downstream side thereof and into the outlet opening.

Each of the expedients described above prevents undissolved alloying ingredient in the molten steel from entering an outlet opening and causes the undissolved alloying ingredient to accumulate on the vessel bottom at a location spaced from the outlet opening while dissolved alloying ingredients of the same and other compositions are allowed to enter the outlet opening.

There is another expedient for preventing the molten metal from following a continuous descending or horizontal path from the entry location to the outlet opening. This alternative comprises flowing the molten metal along a serpentine path, e.g., downwardly, upwardly and then downwardly from the entry location to the outlet opening, thereby causing the undissolved lead or bismuth to settle out on the bottom of the tundish, at a location remote from the outlet opening, as the molten metal changes its direction of flow from downwardly to upwardly. This serpentine motion also increases the recovery of the alloying ingredient (Pb and/or Bi) by increasing the fraction thereof dissolved in the molten steel.

It is undesirable to allow large quantities of undissolved alloying ingredient to accumulate at the bottom of the tundish. Among other reasons, the likelihood of large globules of undissolved alloying ingredient flowing through the outlet opening is increased with an increase in accumulations of undissolved alloying ingredient at the vessel bottom.

The present invention prevents large accumulations of alloying ingredient on the vessel bottom by providing, at the bottom of the tundish, a sump located between the entry location and an outlet opening and having a floor which is lower than the top of the outlet opening. The relatively dense, undissolved molten alloying ingredient collects in the sump, as a result of the difference in density between it and the molten steel. The sump floor is preferably composed of a porous refractory material which is impervious to the molten steel but porous to the molten alloying ingredient at the temperature of the molten steel primarily because of the lower surface tension of the molten alloying ingredient (lead or bismuth) compared to the molten steel, and also, to a lesser extent, because of the lower melting point and lower viscosity of these alloying ingredients. As a result of these properties, the undissolved molten alloying ingredient is drained from the sump through the porous floor material without draining the molten steel therethrough.

Other features and advantages are inherent in the structure and methods claimed and disclosed or will become apparent to those skilled in the art from the following detailed description in conjunction with the accompanying diagrammatic drawings.

DETAILED DESCRIPTION

Figure 1:
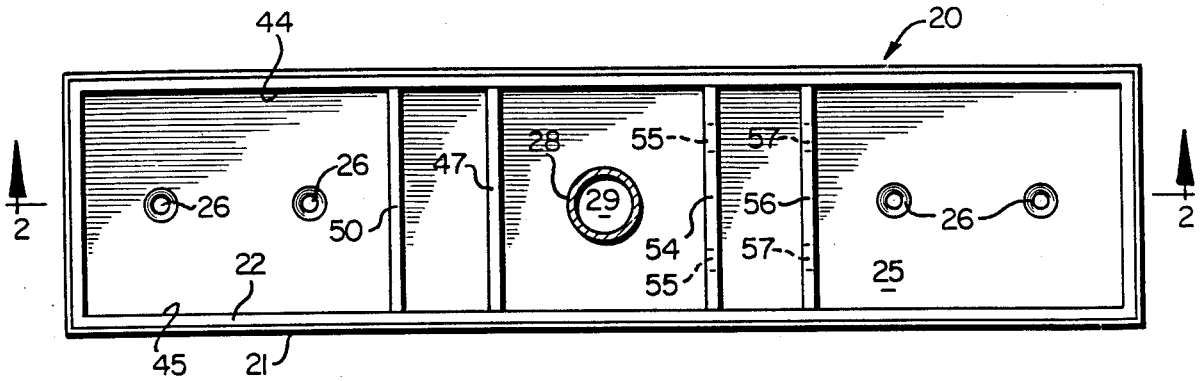
FIG. 1 is a plan view of an embodiment of a tundish in accordance with the present invention.
Figure 2:
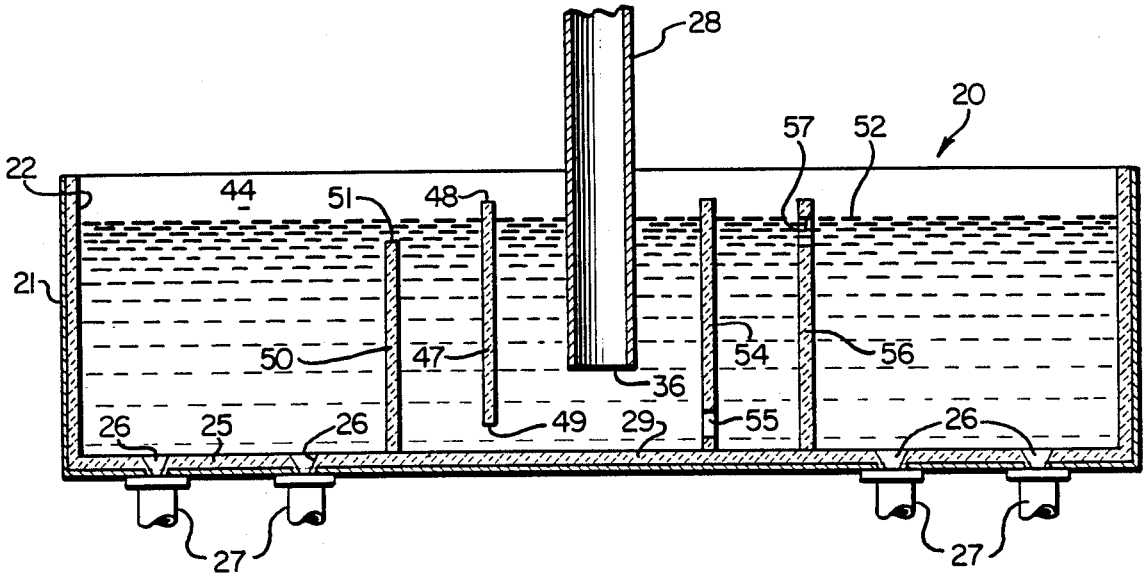
FIG. 2 is a sectional view taken along line 2—2 in FIG. 1.

Referring initially to FIGS. 1 and 2, indicated generally at 20 is an embodiment of a tundish constructed in accordance with the present invention. Tundish 20 comprises a steel shell 21 having an interior refractory lining 22.

Tundish 20 includes a bottom 25 having a plurality of outlet openings 26, 26 each communicating with an outlet conduit or spigot 27. A stream of molten metal from a ladle (not shown) enters tundish 20 through conduit 28 which directs the stream of molten metal toward an entry location 29 on or adjacent tundish bottom 25. Alloying ingredients, such as lead or bismuth, are typically introduced into the stream of molten metal flowing through conduit 28, for example. Entry location 29 is spaced linearly along the vessel bottom from each outlet opening 26. As the tundish fills, the entry location rises to the level of the bottom end 36 of conduit 28. A descending stream of molten metal flows through each outlet opening 26 and its respective spigot 27 into a continuous casting mold (not shown).

The temperature of the molten steel in the tundish is typically 1520°-1550° C. (2770°-2820° F.). The temperature of the molten steel in the ladle which feeds the tundish is typically 1570°-1600° C. (2860°-2910° F.).

Lead and bismuth have a relatively low solubility in molten steel, compared to other alloying ingredients added to molten steel. Because of their relatively low solubility in molten steel, there will be some undissolved lead and bismuth in the molten steel in the tundish, and because molten lead and bismuth have a higher density or specific gravity than molten steel (about 10-11 for bismuth and lead compared to 7 for steel) the lead and bismuth will accumulate at tundish bottom 25. Absent some restraint, the normal flow of molten metal along the tundish bottom will carry large globules of undissolved alloying ingredient (lead and/or bismuth) into the descending stream of molten steel which flows through outlet openings 26, 26 and tubes 27, 27 into the continuous casting mold. These large globules are manifest in the solidified steel product as large, localized concentrations of the alloying ingredient, and this is undesirable.

In accordance with the present invention, a procedure is provided for preventing large globules of the undissolved alloying ingredient from being carried into the descending stream of molten steel. More particularly, the molten metal in tundish 25 is prevented from following a continuous descending or horizontal path across tundish bottom 25 downstream from entry location 29 to the top of an outlet opening 26. This is accomplished by providing one or more of the expedients described below.

Figure 4:
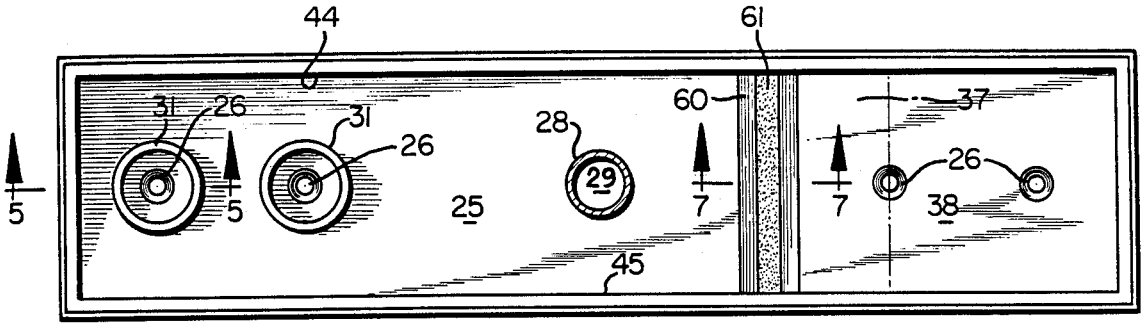
FIG. 4 is a plan view of a further embodiment of a tundish in accordance with the present invention.
Figure 5:
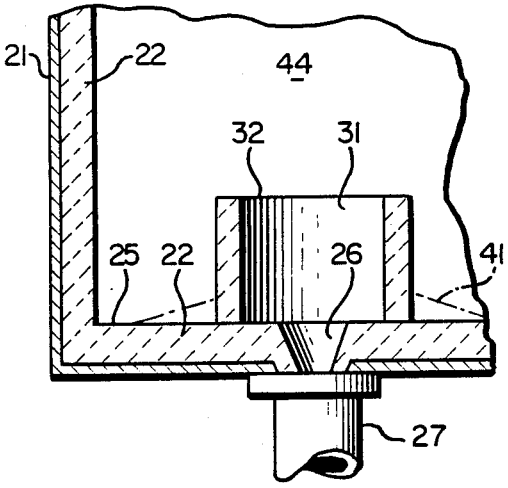
FIG. 5 is an enlarged, fragmentary, vertical sectional view of a portion of one tundish in accordance with the present invention.

FIGS. 4–5 illustrate one expedient wherein an outlet opening 26 is surrounded by an annular refractory dam 31 located between entry location 29 and outlet opening 26. Dam 31 extends upwardly from vessel bottom 25. The dam may be located right at the edge of the outlet opening it surrounds, or it may be spaced up to a few centimeters away from the edge of the opening.

Figure 8:
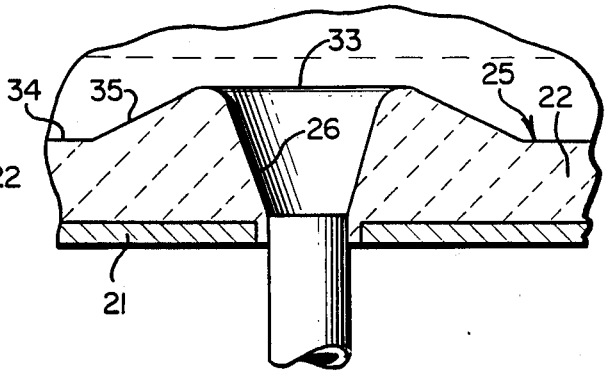
FIG. 8 is an enlarged, fragmentary, vertical sectional view of a portion of still another tundish in accordance the present invention.

Another expedient is illustrated in FIG. 8 wherein the top 33 of outlet opening 26 is raised above that part 34 of vessel bottom 25 surrounding and adjacent the outlet opening. In this embodiment, vessel bottom 25 comprises an upwardly sloping part 35 between vessel bottom part 34 and top 33 of the outlet opening all around the outside of the opening.

Still another expedient is to slope at least part of the vessel bottom portion which is upstream of the outlet opening, upwardly to the outlet opening. A sloping vessel bottom part of this nature is illustrated in dash dot lines at 37 in FIGS. 4 and 7 wherein the vessel bottom part 38 (FIG. 4) which is downstream of sloping bottom part 37 is elevated relative to the bottom parts upstream thereof.

Figure 6:
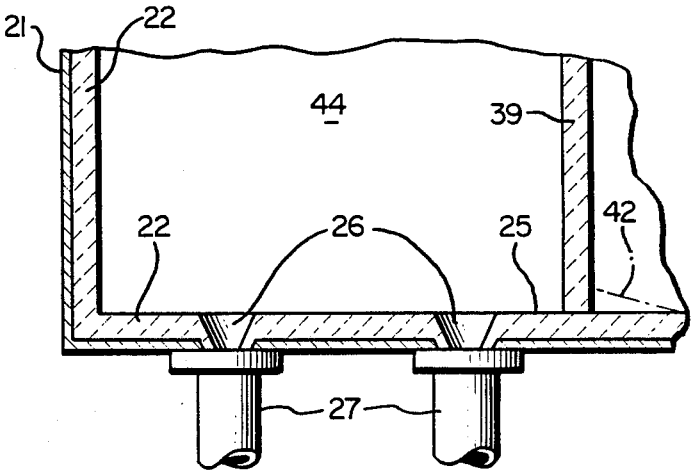
FIG. 6 is an enlarged, fragmentary, vertical sectional view of a portion of another tundish in accordance with the present invention.

Still another expedient is illustrated in FIG. 6 wherein a non-annular refractory dam 39 is interposed between entry location 29 and an outlet opening 26. Dam 39 extends between opposed tundish sidewalls 44, 45, upwardly from vessel bottom 25.

As noted above, a layer of undissolved alloying ingredient accumulates on vessel bottom 25. Typically, this layer accumulates up to 6 mm. in thickness in one heat, at a location between entry location 29 and an outlet 26. The layer is thicker at entry location 29. The top 32 of annular dam 31 (FIG. 5), the top 33 of any raised outlet opening 26 (FIG. 8) and any passageway (not shown) in dam 39 should be higher than the thickness of the layer of undissolved alloying ingredient which accumulates on vessel bottom 25. Typically, annular dam top 32 and raised outlet opening top 33 are located 30-50 mm. above vessel bottom 25, and the bottom of any passageway in dam 39 is located 30-100 mm. above vessel bottom 25.

In addition to having a top 32 located above the layer of undissolved alloying ingredient which accumulates on vessel bottom 25, annular refractory dam 31 is devoid of flow passageways to a height greater than the thickness of the layer of undissolved alloying ingredient which accumulates on the vessel bottom.

As a result of the expedients illustrated in FIGS. 5–8, undissolved alloying ingredient is restrained from entering an outlet opening 26 and accumulates on vessel bottom 25 at a location spaced from the outlet opening while dissolved alloying ingredient of the same composition is allowed to enter the outlet opening.

As shown in FIG. 8, there is no seam, having a vertical component, in the locations on the tundish bottom portion surrounding and adjacent outlet opening 26 at which undissolved, molten alloying ingredient accumulates.

Because of factors characteristic to a continuous casting operation, annular dam 31 and non-annular dam 39 are usually located atop vessel bottom 25 and are usually not embedded within refractory lining 22 (FIGS. 5–6). Absent some restraint, undissolved alloying ingredient could accumulate around the outer side of annular refractory dam 31 and at the upstream side of non-annular dam 39. Such accumulations of alloying ingredient could seep under annular dam 31 or non-annular dam 39 or through gaps at the bottom of each, both of which rest atop tundish bottom 25 rather than being embedded in refractory 22, as previously noted. Such seepage would be undesirable because undissolved alloying ingredient which got past a dam in this manner would be carried into the outlet opening, with all the undesirable consequences thereof.

In accordance with the present invention, undissolved alloying ingredient is prevented from accumulating around the outer side of annular refractory dam 31 by sloping the vessel bottom portion around the of dam 31, upwardly to the dam. This is illustrated in dash dot lines at 41 in FIG. 5. Similarly, undissolved alloying ingredient is prevented from accumulating at the upstream side of non-annular dam 39 by sloping the vessel bottom portion at the upstream side of dam 39, upwardly to the dam to a height above the tunish bottom portion on the downstream side of the dam. This is illustrated in dash dot lines at 42 in FIG. 6.

Another expedient for preventing the molten metal from following a descending or horizontal path across the vessel bottom, between entry location 29 and an outlet opening 26, comprises directing the molten metal along a serpentine path including successive down and up portions between entry location 29 and outlet opening 26, to settle out the more dense, undissolved alloying ingredient from the molten metal at a location remote from the outlet opening, as the molten metal reverses flow from a downward to an upward direction. This expedient is best illustrated in FIGS. 1 and 2.

More particularly, tundish 20 has a pair of sidewalls 44, 45. Extending between these side walls are a weir 47 and a dam 50. The level of molten metal in tundish 20 is controlled, and weir 47 has a top 48 normally located above the top surface 52 of the molten metal in the tundish. Weir 47 also has a bottom 49 spaced above tundish bottom 25. Dam 50 extends upwardly from tundish bottom 25 and terminates at a top 51 normally located below top surface 52 of the molten metal in the tundish.

Weir 47 and dam 50 function to direct molten metal, entering the tundish through conduit 28, along a serpentine path including successive down and up portions between entry location 29 and outlet opening 26. More particularly, molten metal entering tundish 20 through conduit 28 at entry location 29 initially flows downwardly and underneath the bottom 49 of weir 47, then changes direction and flows upwardly between weir 47 and dam 50 until it reaches the top 51 of dam 50 over which it flows to the downstream side of dam 50, where outlet openings 26, 26 are located.

As the molten metal follows the path described in the preceding paragraph, the denser, undissolved alloying ingredient in the molten metal settles out from the molten metal as the molten metal reverses direction of flow from downward to upward adjacent weir bottom 49. Conversely, if the molten steel also contains non-metallic inclusions which are less dense than the molten steel, these inclusions will be urged toward top surface 52 of the molten metal, as the molten metal reverses direction of flow from upward to downward adjacent dam top 51, and the inclusions will accumulate on top surface 52, which is desirable.

The type of serpentine motion provided by weir 47 and dam 50 may also be provided by a pair of dams 54, 56 spaced apart in a downstream direction (FIGS. 1–2). The upstream dam of the two, dam 54, has a lower opening 55 while the downstream dam 56 has an upper opening 57. Molten metal exits conduit 28 in a downward direction, flows through lower opening 55 in dam 54, then flows upwardly between dam 54 and dam 56, then flows through top opening 57 in dam 56 to the downstream side of dam 56, where outlet openings 26, 26 are located. Undissolved alloying ingredient settles out in the area between dams 54 and 56, the molten stream changing direction from downwardly to upwardly adjacent lower opening 55 in dam 54.

The desired downward, upward and then downward motion can also be obtained by reversing the respective locations of weir 47 and dam 50 or of dams 54 and 56. In such a case, the undissolved alloying ingredient settles out between entry location 29 and the closest downstream dam.

Figure 3:
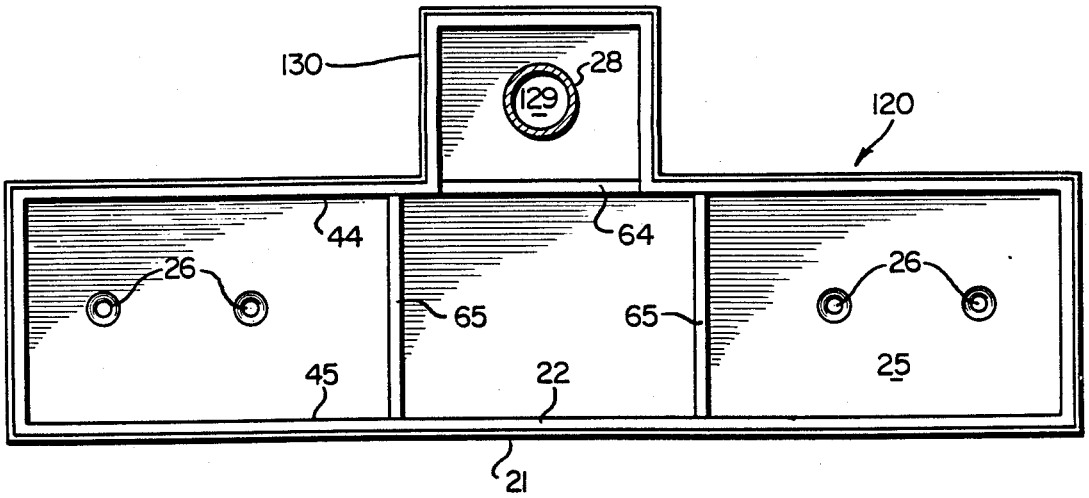
FIG. 3 is a plan view of another embodiment of a tundish in accordance with the present invention.

Referring now to FIG. 3, there is illustrated an embodiment of a tundish indicated generally at 120 wherein the molten metal entering the tundish through entry conduit 28 is directed towards an entry location 129 in an appendage 130 of tundish 120. To provide the desired serpentine motion for the molten metal as it moves from entry location 129 to outlet openings 26, 26, tundish 120 is provided with a weir 64 which functions like weir 47 in the embodiment of FIGS. 1–2 and with dams 65, 65 which function like dam 50 in the embodiment of FIGS. 1–2. Undissolved alloying ingredient which settles out from the molten metal as it follows its serpentine path accumulates in that part of tundish 120 located between dams 65, 65. Desirably, a sump such as that shown at 60 in FIG. 7, would be located in this area. Sump 60 will be described in more detail below. As an alternative, a weir may be placed at the location of each dam 65 and a dam placed at the location of weir 64, to impart serpentine motion to the molten metal.

In addition to producing the serpentine motion with weirs and dams as shown in FIGS. 1–3, the serpentine motion can be induced by other expedients such as gas bubblers, electromagnetic stirring, differential cooling, etc.

The serpentine motion, imparted by the various expedients described above, also increases the recovery of the alloying ingredient by increasing the fraction thereof which is dissolved in the molten steel.

In addition to the expedients illustrated in FIGS. 1–3, the tundish may include one or more of the expedients illustrated in FIGS. 5–8, all of which perform the function of preventing the molten metal in the tundish from following a continuous descending or horizontal path across the vessel bottom downstream from entry location 29 to the top of an outlet opening 26. As a result, large globules of undissolved alloying ingredient are prevented from being carried through an outlet opening 26 into the strand of molten metal entering the continuous casting mold.

Figure 7:
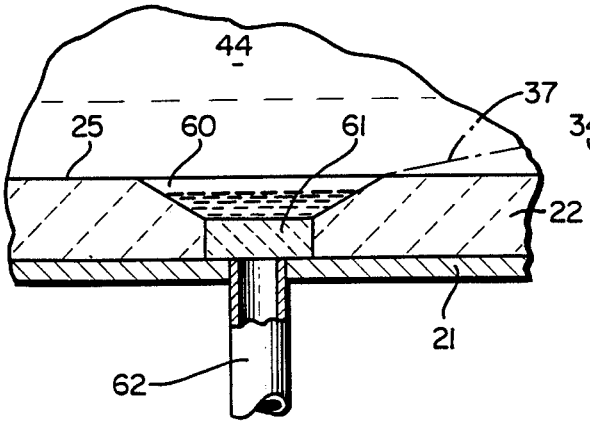
FIG. 7 is an enlarged, fragmentary, vertical sectional view of a portion of a further tundish in accordance with the present invention.

Another procedure for preventing large globules of undissolved alloying ingredient from being carried into the stream of molten metal entering the casting mold is illustrated in FIGS. 4 and 7.

More particularly, tundish bottom 25 is provided with a sump 60 located between entry location 29 and an outlet opening 26. As shown in FIGS. 4 and 7, tundish bottom 25 has a part located upstream of sump 60 and a part located downstream of sump 60. Entry location 29 and the bottom part containing the entry location are physically separated from outlet opening 26 by sump 60. Sump 60 has a floor 61 which is lower than the top of any outlet opening 26 and lower than the bottom of the tundish. Molten metal flows from entry location 29 to outlet opening 26 along a path which crosses sump 60. Sump floor 61 is lower than the tundish bottom parts located upstream and downstream of sump 60. Undissolved molten alloying ingredient collects in sump 60, as a result of the difference in density between the molten alloying ingredient (e.g. lead or bismuth) and the molten steel.

In a preferred embodiment, sump floor 61 is constructed from a porous refractory material which is impervious to molten steel but is porous to the molten alloying ingredient primarily because the molten alloying ingredient (lead and/or bismuth) has a lower surface tension than the molten steel. Also contributing to this effect are the fact that the lead and/or bismuth have a lower melting point than the molten steel and, to a lesser extent, the fact that the molten alloying ingredient is less viscous than the molten steel at the temperature of the molten steel. As a result of the factors described above, the undissolved molten alloying ingredient which accumulates in sump 60 drains from the sump through porous floor 61 while the molten steel will not drain therethrough. Communicating with the bottom of floor 61 is the upper end of a drain conduit 62. Molten alloying ingredient draining from sump 60 enters conduit 62 which conducts it away from tundish 20.

In FIG. 4, sump 60 is shown as extending between tundish sidewalls 44, 45 at a location between entry location 29 and outlet openings 26, 26. An alternative would be an annular sump surrounding each outlet opening 26. A further alternative would be a circular sump located between entry location 29 and an outlet opening 26 with that part of vessel bottom 25 surrounding the circular sump sloping downwardly toward the sump for a substantial distance.

Examples of porous refractory material from which sump floor 61 may be composed are set forth below.

| | |
|---|---|
| Example A | |
| $Al_2O_3$ | 60-75 wt. % |
| $SiO_2$ | 25-40 wt. % |
| CaO, $TiO_2$, $Na_2O$, $K_2O$ as minor constituents | |
| Example B | |
| $Al_2O_3$ | 75 to 98 wt. % |
| $SiO_2$ | 0 to 25 wt. % |
| $ZrO_2$, CaO, $TiO_2$, $Na_2O$, $K_2O$ as minor constituents | |
| Example C | |
| MgO | 60 to 96 wt. % |
| $SiO_2$ | 2 to 15 wt. % |
| CaO | 2 to 15 wt. % |
| Example D | |
| $ZrO_2$ | 60 to 100 wt. % |
| $SiO_2$ | 0 to 40 wt. % |
| $Al_2O_3$ | 10 to 20 wt. % |

As shown in FIGS. 4 and 7, sump 60 may be positioned adjacent the upstream, lower end of sloping floor portion 37, the downstream upper end of which is located adjacent an outlet opening 26. Thus any undissolved alloying ingredient which may settle out on sloping floor portion 37 will be directed downwardly into sump 60.

As noted above, the preferred embodiment of sump has a porous floor. In a sump without a porous floor, lead and/or bismuth accumulating therein would remain after the tundish has been emptied of molten steel, and the lead and/or bismuth would solidify into a skull which would be mechanically removed from the tundish before the next cast.

Examples of molten steel with which the present invention may be employed comprise any steel to which lead and bismuth have heretofore been added to improve machinability.

In addition to steels containing lead and/or bismuth, the present invention is applicable to steels containing other alloying ingredients having at least some of the above-described properties of lead and bismuth. These properties comprise, at the very least, an insolubility in molten steel sufficient to provide substantial amounts of undissolved alloying ingredient in the molten steel in the tundish and a density greater than molten steel. Other properties comprise a surface tension less than molten steel, a melting point less than steel, and a viscosity less than that of the molten steel at the temperature of the molten steel in the tundish.

The foregoing detailed description has been given for clearness of understanding only, and no unnecessary limitations should be understood therefrom, as modifications will be obvious to those skilled in the art.

We claim:

1. A tundish for use in producing a continuously cast steel shape from molten steel containing an undissolved, molten alloying ingredient having a density greater than said molten steel, said tundish comprising:

a tundish bottom;

tundish walls, including opposed tundish sidewalls, extending upwardly from the periphery of said bottom;

an outlet opening at said bottom, said outlet opening having a top and comprising means for forming a descending stream of molten metal;

means for receiving molten metal within said tundish at an entry location spaced linearly along the tundish bottom from said outlet opening;

and structure for preventing large globules of undissolved, molten alloying ingredient from being carried into said descending stream, said structure comprising at least of the following expedients (a)–(d);

(a) a raised outlet opening top located above at least that part of the tundish bottom surrounding and adjacent said outlet opening;

and a tundish bottom portion sloping upwardly to the top of said outlet opening on opposite upstream sides of said opening;

there being no seam, having a vertical component, in the locations on the tundish bottom portion surrounding and adjacent said outlet opening at which undissolved, molten alloying ingredient accumulates;

(b) a refractory dam surrounding said outlet opening, located between said entry location and said outlet opening and extending upwardly from the tundish bottom;

and a tunish bottom portion sloping upwardly to said surrounding dam, around the outer side of the dam, said upwardly sloping bottom portion comprising means for preventing said undissolved, molten alloying ingredient from accumulating around the outer side of said dam throughout a continuous casting operation;

(c) a sump at the bottom of said tundish, said sump being located between said entry location and said outlet opening and lying across the path of molten metal flowing from said entry location to said outlet opening;

said tundish bottom having a part which is located upstream of said sump and a part which is located downstream of said sump;

said sump having a floor which is lower than the top of said outlet opening and lower than the tundish bottom parts located upstream and downstream of the sump;

said entry location being at the tunish bottom part which is upstream of the sump;

said outlet opening being located on the tundish bottom part which is downstream of the sump;

said entry location and the bottom part which contains said entry location being physically separated, by the sump, from the bottom part which contains said outlet opening, whereby said molten metal flowing from said entry location to said outlet opening flows along a path crossing said sump;

said sump comprising means for collecting undissolved, molten alloying ingredient as a result of the difference in density between said molten alloying ingredient and said molten steel; and (d) an elongated refractory dam interposed between said entry location and said outlet opening, said elongated dam extending, from on tundish sidewall to the other sidewall, upwardly from the tundish bottom above the level of the outlet opening, said dam being devoid of flow passageways to a height greater than the thickness of the layer of undissolved alloying ingredient normally allowed to accumulate on the tundish bottom;

said dam resting atop said tundish bottom;

a tundish bottom portion on the upstream side of said dam and a tundish bottom portion on the downstream side of the dam;

said tundish bottom portion on the upstream side of said dam sloping upwardly to said dam to a height above the tundish bottom portion on the downstream side of the dam;

said upwardly sloping bottom portion comprising means for preventing said undissolved, molten alloying ingredient from accumulating at the upstream side of said dam;

each of said expedients (a)-(d) comprising means operable throughout a continuous casting operation, for restraining undissolved, molten alloying ingredient from entering said outlet opening and for causing said undissolved, molten alloying ingredient to accumulated on tundish bottom at a location spaced from the outlet opening while allowing dissolved, molten alloying ingredient of the dam composition to enter the outlet opening;

each of said expedients (a), (b) and (d) comprising means for preventing molten metal in said tundish from following a continuous descending or horizontal path across the tundish bottom downstream from said entry location to the top of said outlet opening;

expedient (a) comprising means for accumulating said undissolved, molten alloying ingredient on the tundish bottom at locations spaced from the outlet opening, on opposite upstream sides of said opening;

expedient (b) comprising means for accumulating said undissolved, molten alloying ingredient on the tundish bottom at locations spaced from the outer side of the surrounding dam, all around the dam;

and expedient (d) comprising means for accumulating undissolved, molten alloying ingredient on the tundish bottom at a location spaced from the outlet opening and from the elongated dam on the upstream side of the dam.

2. A tundish as recited in claim 1 and comprising expedient (a) and wherein:

the top of said raised outlet opening is at a height greater than thickness of the layer of undissolved alloying ingredient normally allowed to accumulate on the tundish bottom.

3. A tundish as recited in claim 1 and comprising expedient (b) and wherein;

said surrounding refractory dam is devoid of flow passageways to a height at least equal to the thickness of the layer of undissolved alloying ingredient normally allowed to accumulate on the tundish bottom.

4. A tundish as recited in claim 1 and comprising expedient (b) and wherein:

said surrounding refractory dam has a height greater than the thickness of the layer of undissolved alloying ingredient normally allowed to accumulate on the tundish bottom.

5. A tundish as recited in claim 1, wherein said undissolved alloying ingredient has a surface tension less than said molten steel at the temperature of said molten steel, said tundish comprising expedient (c) and wherein:

said sump floor is composed of porous refractory material which is impervious to molten steel but porous to said undissolved alloying ingredient at the temperature of molten steel;

and said tundish comprises means for draining the undissolved molten alloying ingredient from said sump through said porous floor material without draining said molten steel therethrough.

6. A tundish as recited in claim 1 and comprising expedient (d) and further comprising:

means for directing said molten metal along a serpentine path including successive down, up and down portions between said entry location and said outlet opening to settle out said undissolved alloying ingredient from said molten metal at a location remote from the outlet opening as the molten metal reverses flow from a downward to an upward direction.

7. A tundish as recited in claim 1 wherein said one expedient is expedient (a).

8. A tundish as recited in claim 1 wherein said one expendient is expedient (b).

9. A tundish as recited in claim 1 wherein said one expedient is expedient (c).

10. A tundish as recited in claim 1 wherein said one expedient is expedient (d).

11. A tundish as recited in claim 1 wherein said expedients comprise expedient (a) in combination with at least one of the other three expedients.

12. A tundish as recited in claim 1 wherein said expedients comprise expendient (b) in combination with at least one of the other three expedients.

13. A tundish as recited in claim 1 wherein said expedients comprise expendient (c) in combination with at least one of the other three expedients.

14. A tundish as recited in claim 1 wherein said expedients comprise expedient (d) in combination with at least one of the other three expedients.

15. A tundish as recited in claim 1 wherein said expedients comprise expedient (a) in combination with at least two of the other three expedients.

16. A tundish as recited in claim 1 wherein said expedients comprise expedient (b) in combination with at least two of the other three expedients.

17. A tundish as recited in claim 1 wherein said expedients comprise expendient (c) in combination with at least two of the other three expedients.

18. A tundish as recited in claim 1 wherein said expedients comprise expedient (d) in combination with at least two of the other three expedients.

19. A tundish as recited in claim 1 wherein said expedients comprise all of expedients (a)–(d).

* * * * *